United States Patent [19]

Carter et al.

[11] 3,969,693

[45] July 13, 1976

[54] PASSIVE MICROWAVE POWER DISTRIBUTION SYSTEMS

[75] Inventors: John L. Carter, Ocean; Joseph McGowan, Spring Lake Heights, both of N.J.

[73] Assignee: The United States of America as represented by the Secretary of the Army, Washington, D.C.

[22] Filed: Apr. 25, 1975

[21] Appl. No.: 571,670

Related U.S. Application Data

[62] Division of Ser. No. 482,946, June 25, 1974, Pat. No. 3,953,853.

[52] U.S. Cl. ..... 333/98 S; 333/7 R; 333/31 A

[51] Int. Cl.[2] ..... H01P 1/10; H01P 1/18; H01P 1/32; H01P 5/12

[58] Field of Search ..... 333/1.1, 7, 13, 17, 333/24.1, 97 R, 98 S

[56] References Cited

UNITED STATES PATENTS

| | | | |
|---|---|---|---|
| 2,970,283 | 1/1961 | Griemsmann | 333/13 X |
| 3,155,925 | 11/1964 | Wantuch | 333/7 |
| 3,195,074 | 7/1965 | Rebsch | 333/7 D |
| 3,333,214 | 7/1967 | Parris | 333/98 S |

OTHER PUBLICATIONS

Southworth–Principles and Applications of Waveguide Transmission, D. Van Nostrand, New York, 1961; pp. 604–606.

*Primary Examiner*—Alfred E. Smith
*Assistant Examiner*—Marvin Nussbaum
*Attorney, Agent, or Firm*—Nathan Edelberg; Jeremiah G. Murray; Sheldon Kanars

[57] ABSTRACT

A standby microwave transmitter power amplifier tube is switched into a microwave power distribution system for a phased array in microseconds when any transmitter tube feeding any one of the radiating elements falls and all the radiating elements continue to be fed by respective transmitter tubes after the switching is completed, the switching being accomplished by changing electrical length of a quarter-wavelength waveguide stub to one-half wavelength by switching a reciprocal latching ferrite phase shifter in the stub, in response to termination of microwave power from one of the feed tubes.

1 Claim, 6 Drawing Figures

FIG. 1 (Prior Art)
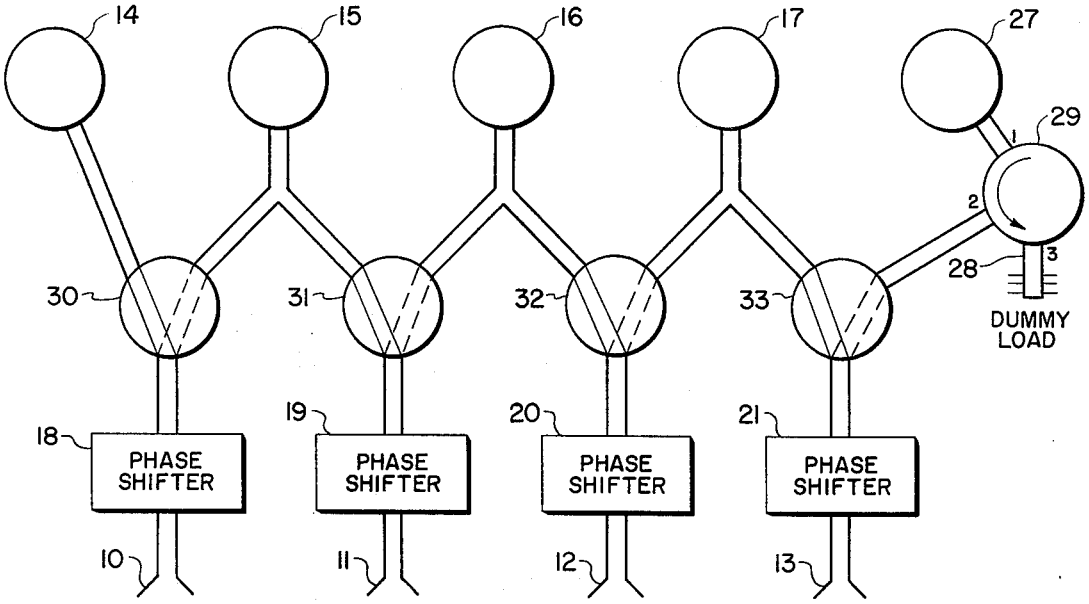
FIG. 2
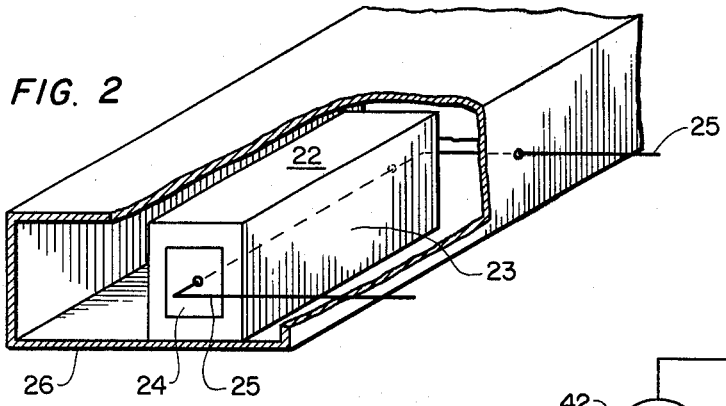
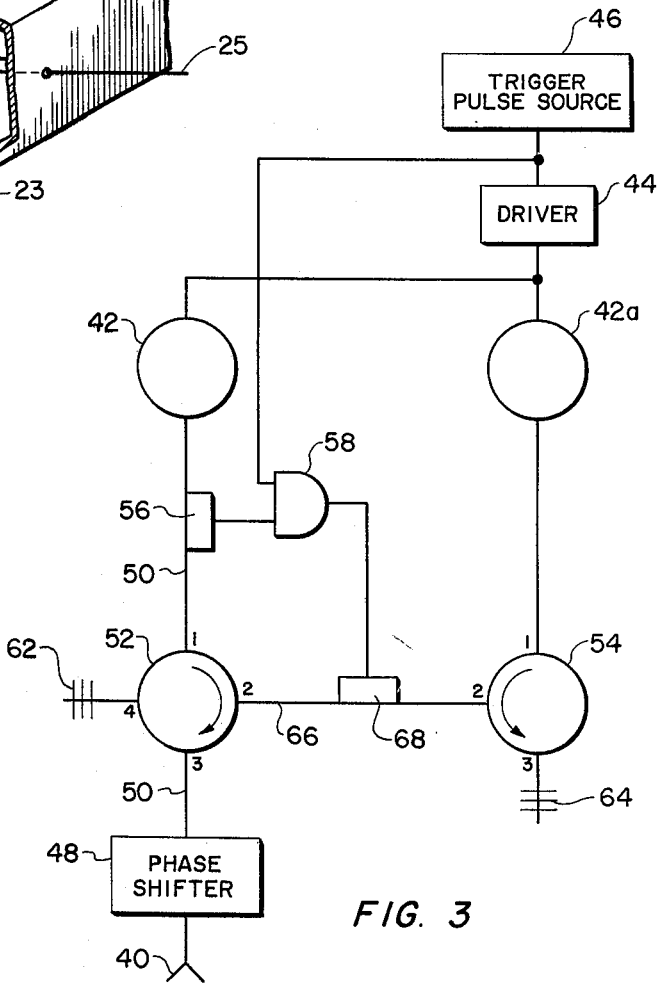
FIG. 3

FIG. 4
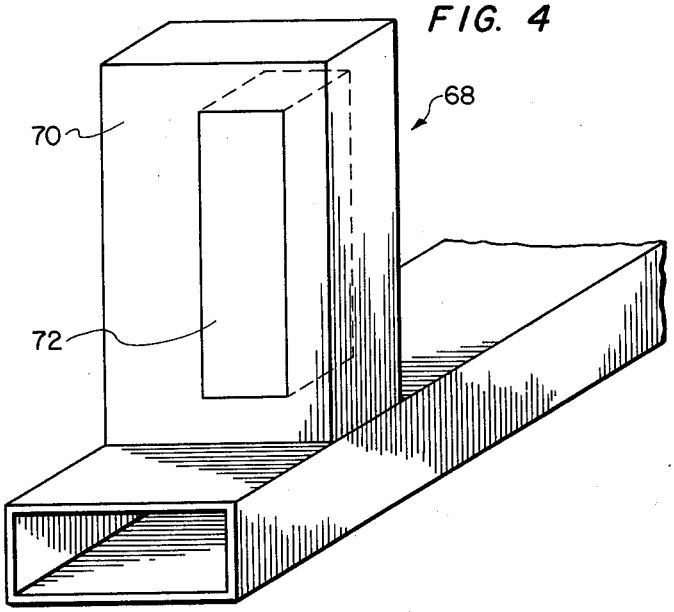
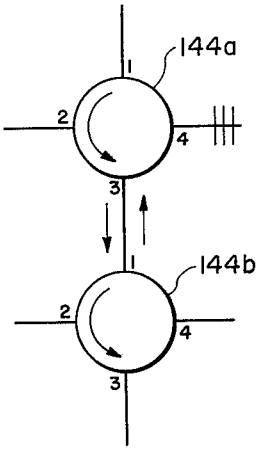
FIG. 6
FIG. 5
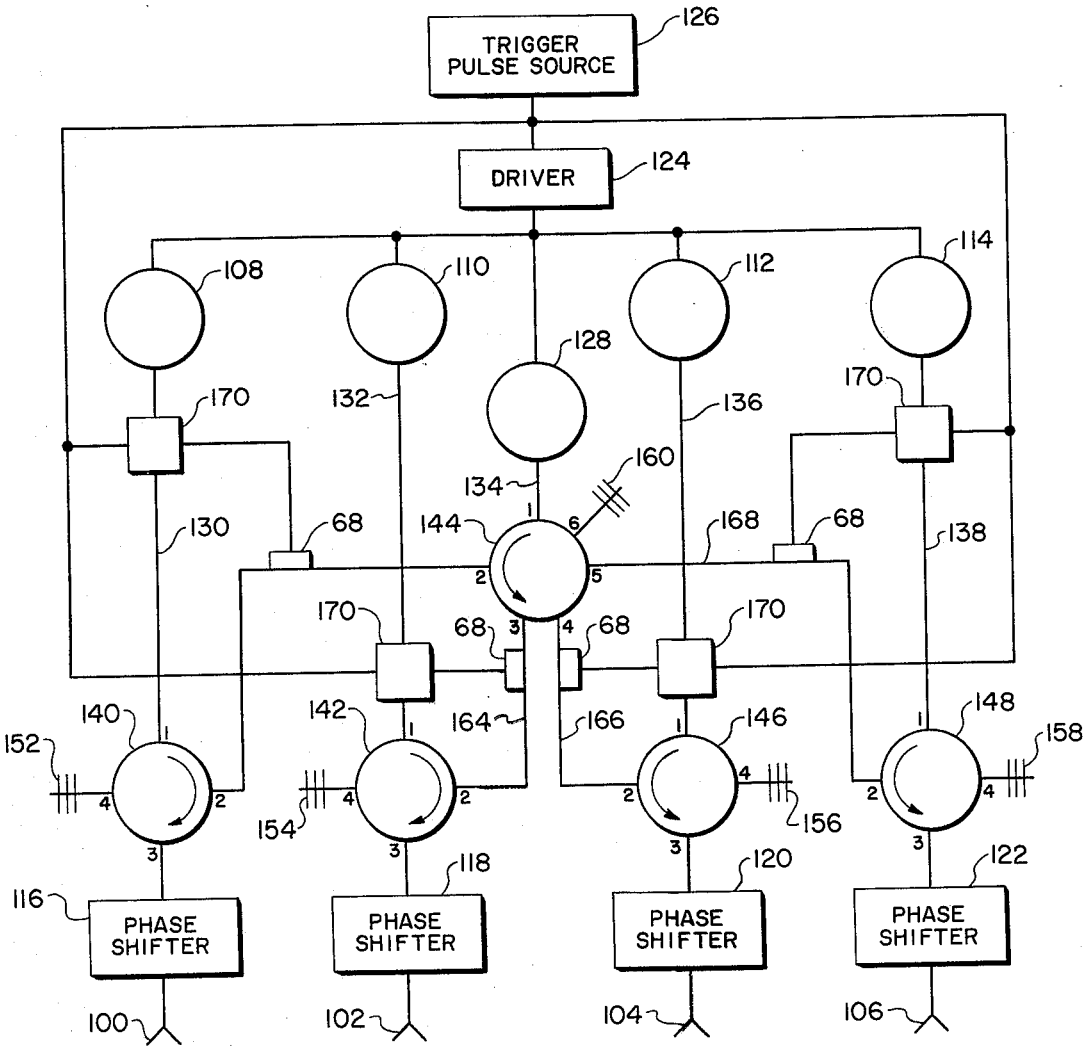

PASSIVE MICROWAVE POWER DISTRIBUTION SYSTEMS

This is a division of application Ser. No. 482,946, filed June 25, 1974, now U.S. Pat. No. 3,953,853.

BACKGROUND OF THE INVENTION

A phased array system includes N identical radiators supported as an array. Separate phase shifter means is connected in series with any number of the radiators and N identical microwave power amplifier tubes feed the respective radiator and phase shifter combinations. The microwave power tubes provide in-phase identical outputs. A tube may arc or it may fall entirely. It has been conventional practice to include protective circuitry in the transmitter for responding to arcing to terminate power to the tube. Whether there is arcing or the tube falls, the tube output ceases and the array is effectively inoperative. The most primitive method of correcting the condition has been to shut down to replace the defective tube. This method was improved by running an additional tube into a dummy load as a standby and upon non-operation of one of the tubes feeding one of the radiators, operating a valve-type waveguide switching device to switch in the standby tube. This method was automated by monitoring microwave power output of each feed tube and including relay-controlled solenoid-operated valve-type waveguide switching devices between the tubes and the radiators so that if any of the tubes failed, the switching devices rearranged the relationship of tubes and radiators fed thereby, so that every radiator was fed by a tube after switching. A three-port circulator coupled the standby tube alternatively to a dummy load or to one of the solenoid-operated valve-type microwave switches. Besides being cumbersome, this system is too slow, having 0.1 second to 0.5 second response time. A number of pulse periods are lost in that time. For radars having missile sensing functions, loss of several pulse periods at a critical juncture requires correction.

SUMMARY OF THE INVENTION

A standby power amplifier tube is substituted for a power amplifier tube that ceased operation, in a minor fraction of the time required by prior art systems. A standard commercial type-four-port circulator is provided for each radiating element and its respective power tube. Another circulator with two more ports than the number of radiating elements is provided for the standby tube. Microwave power from each power tube feeding a radiating element is monitored continuously. When all the power tubes are operating, power output of the standby tube is coupled by its circulator to a dummy load. However, as soon as one of the power tubes feeding a radiating element does not deliver power, power from the standby tube is channelled automatically to the circulator between the non-operating tube and the respective radiating element and the standby tube is operationally substituted for the non-operating tube. There is a waveguide between one port of each four port circulator and a respective port of the standby tube circulator. Each waveguide has a high power switch. Each switch is a quarter-wave stub unit, in series, and a ferrite reciprocal latching phase shifter in the stub and electrically coupled to the respective microwave power monitor. In standby, the stub and its latching phase shifter reflect incident power from the standby tube and from the four-port circulator. The response of each monitor circuit to the absence of microwave power is to bias the corresponding latching phase shifter to its other state to change the electrical length of the quarter-wave stub unit to one-half wavelength whereby the stub unit is close-circuited and the power from the standby tube is channelled through that waveguide. Circuit response is fast enough to complete a switching action between driver pulses whereby there is no decrease in data acquisition rates. All of the elements used in the invention are standard waveguide components.

DESCRIPTION OF THE DRAWINGS

FIG. 1 is a diagrammatic representation of a prior art system improved by this invention;

FIG. 2 is a perspective view of a known ferrite reciprocal latching phase shifter in a waveguide section that is broken away to expose the phase shifter;

FIG. 3 is an embodiment of this invention including one power tube and one standby tube to be automatically substituted for the power tube;

FIG. 4 is a perspective view of a switch according to this invention;

FIG. 5 is another embodiment in the form of a phased array that operates on the same principles as the embodiment in FIG. 3; and FIG. 6 is an explanatory diagram showing a six-port circulator used in FIG. 5 that is a combination of two four-port circulators.

DESCRIPTION OF THE PREFERRED EMBODIMENT

In a prior art phased array system outlined in FIG. 1, four radiating elements 10, 11, 12, 13 are the microwave power loads of four microwave power amplifier feed tubes 14, 15, 16 and 17. Ferrite latching phase shifters 18, 19, 20 and 21 are in series with the respective radiating elements. The structure of the ferrite latching phase shifter 22 is shown in FIG. 2 and is discussed in an article entitled "A Digital Current Controlled Latching Phase Shifter" by WHICKER and JONES in IEEE Transactions on Microwave Theory and Techniques, Vol. MTT-14, pp. 45–46, January 1966. These phase shifters are marketed commercially by several of the well known American companies in the business of marketing waveguide plumbing and ancillary microwave components. The phase shifters are custom-made to satisfy customer specification such as (1) phase shift angle, (2) tolerance or phase deviation, (3) power handling capacity, (4) switching speed, (5) size of waveguide in which the phase shifter is to be mounted and (6) switching energy.

The phase shifter 22 has the configuration of a rectangular bar and includes a ferrite rectangular toroid 23; the rectangular interior of the ferrite is filled with a dielectric 24 of very high dielectric constant. A conductor 25 extends through the center of the phase shifter 22 for switching the phase shifter. Its width is equal to the narrow side dimension of the waveguide and its thickness is about ⅓ of the broad side dimension. For 90° phase shift, the length dimension is on the order of 1½ to 2 waveguide wavelengths. In place in a waveguide 26, its center plane is parallel to the narrow sides of the waveguide and is at a distance from one narrow side that is about ⅜ of the width of the broad side of the waveguide. Supporting means, not shown, is an H-plane waveguide tee which is marketed by the same companies that market the phase shifter. The conductor 25 extends through very small holes in the adjacent narrow side of the waveguide. The phase shifter and switching energy may be designed for two-state operation. In one state the phase shifter is nearly transparent to microwave energy propagated along the waveguide. In its other state, the phase shifter introduces the phase shift angle for which it is designed. For operational flexibility, several phase shifters, each designed for producing different degrees of phase shift and independently controlled are arranged in-line longitudinally along the waveguide; the total phase shift is equal to the sum of the phase shifts introduced by the several in-line phase shifters.

In FIG. 1, a fifth microwave power feed tube 27 is on standby, delivering its power to a dummy load 28 through a three-port circulator 29. The tube 27 is coupled to the first port of the circulator 29 and the dummy load is coupled to the third port of the circulator. Solenoid-operated valve-type switching devices 30, 31, 32, 33 are provided for switching in the standby tube 27 when one of the tubes 14, 15, 16, 17 is non-operative. If tube 14 does not operate, all of the switching devices 30, 31, 32, 33 are operated to their alternate positions; if tube 16 does not operate, switching devices 32, 33 are operated; if tube 17 fails, only switching device 33 is operated. Power output of all the tubes 14, 15, 16, 17 is monitored by means not shown in FIG. 1, and failure of any of the tubes is sensed by its monitor which triggers a control circuit, not shown, for activating one or more of the solenoids so that the standby tube is switched into the system. All of the components shown in FIG. 1 are commercially marketed and/or are well known in the art. Solenoid-operated waveguide switching devices of the type used in the system shown in FIG. 1 are relatively slow requiring 0.1 to 0.5 seconds to switch from one position to the other. In missile detection radar, the maximum inactive period must be shorter, preferably substantially less than 100 microseconds.

The embodiment of the invention shown in FIG. 3 illustrates the broader aspects of this invention. A radiator element 40 is coupled to the output of a microwave power output feed tube 42. A driver circuit 44 is controlled by a timer or trigger pulse source 46 is coupled to the input of tube 42. A phase shifter means 48 of the type described is included in the waveguide 50 propagating the power from tube 42 to radiating element 40; in this embodiment, the phase shifter is optional. A standby tube **42*a* is operated from the same driver, running continuously to substitute for tube 42 in the event the latter ceases delivering power. Automatic faster acting means for effectuating the substitution includes a four-port circulator 52 for tube 42, a three-port circulator 54 for the tube 42*a*, a conventional microwave monitoring probe and means for rectifying signals picked up by the probe 56, and a NAND gate 58 that is connected to the output of the trigger pulse source 46 and to the output of the monitoring probe and rectifying means 56 which supplies a switching pulse to the high power novel waveguide switch 68 when a pulse is absent from the output of tube 42**. The NAND gate is shown in its simplest logic circuit form for response to the absence of one pulse; one may be designed that will respond to two or more absent pulses.

The output of tube 42 is propagated to the first port of circulator 52; the third port is coupled to radiating element 40 and a dummy load 62 terminates the fourth port. The output of tube **42*a* is propagated to the first port of circulator 54; the third port is terminated by dummy load 64. Waveguide 66 couples the second ports of the two circulators. The waveguide 66 includes a two-state waveguide switch means 68**; in one state it reflects incident power from either direction and in the other state it is essentially transparent to incident power.

The switch 68 shown in FIG. 4 is a combination quarter-wave stub 70 and a 90° ferrite latching phase shifter 72 of the same type as 48, supported in the same orientation as in FIG. 2. The nominal quarter-wavelength stub is made an odd multiple of one-quarter wavelengths according to the length of the phase shifter and its supporting elements. In one state, the phase shifter is an energy transparent component in the stub and the latter functions as if the phase shifter weren't there. In its other state the phase shifter changes the electrical length of the stub by 90° so that the switch is closed.

In normal operation, the switch 68 is in its blocking state and reflects power incident from either direction. Microwave power from tube 42 enters port 1 of circulator 52, circulates to port 2 where it is reflected back from switch means 68 and continues out port 3 to the radiating element 40; any power that is not radiated and continues on to port 4 is absorbed in dummy load 62. At the same time, power from the standby tube **42*a* enters port 1 of circulator 54, continues to port 2, is reflected by switch means 68, and continues on to port 3 where it is absorbed by dummy load 64. If the amplifier tube 42 should fail to deliver an output pulse, the NAND gate 58 delivers a switching pulse to the switch means 68. The power entering port 1 of circulator 54 exits port 2 and enters port 2 of circulator 52 to exit at port 3** and is radiated.

A phased array according to this invention, shown in FIG. 5, operates on the same principles as the embodiment of FIG. 3. It includes four radiating elements 100, 102, 104, 106 that are the microwave power loads of four power feed tubes 108, 110, 112, 114. Ferrite latching phase shifters 116, 118, 120, 122 are in series with the radiating elements. A driver circuit 124 controlled by a timer or trigger pulse source 126 operates into all the tubes 108, 110, 112, 114 and in addition operates into a standby tube 128 that is the same as all the other tubes. Waveguides 130, 132, 134, 136, 138 couple the outputs of tubes 103, 110, 128, 112, and 114 to port 1 of the circulators 140, 142, 144, 146, 148 respectively. Circulator 144 has six ports; all the others have four ports. One structural arrangement for six-port circulator 144 is shown in FIG. 6 and includes the two four-port circulators **144*a*, 144*b*. The third port of circulator 144*a* is coupled to the first port of the circulator 144*b* whereby the six ports of the circulator combination 144, in succession, are ports 1 and 2 of circulator 144*a*, ports 2, 3, 4 of circulator 144*b* and the fourth port of circulator 144*a*. Dummy loads 152, 154, 156, 158 terminate the fourth port of circulators 140, 142, 146, and 148 respectively; dummy load 160 terminates the sixth port of circulator 144. Normally open-circuited waveguides 162, 164, 166, 168 couples the second, third, fourth and fifth ports of circulator 144 to the second ports of circulators 140, 142, 146, 148; these waveguides each include a switch means 68 comprising a quarter-wavelength stub in which is mounted a ferrite latching phase shifter as shown in FIG. 4. The outputs of each of the tubes 108, 110, 112 and 114 are monitored as in FIG. 2 and a logic circuit is coupled to the trigger pulse source 126 and to the respective monitoring means. Respective monitoring means and logic circuit are combined in a single block 170. The standby tube 128 substitutes directly for the tube that ceases to operate as opposed to the musical chairs arrangement in FIG. 1.**

What is claimed is:

1. In combination with a waveguide, a lateral stub that is an odd number of quarter-wavelengths long for reflecting energy arriving from either direction in the waveguide, and a ferrite latching phase shifter mounted in said stub that is approximately transparent to microwave energy in one latched state and is operable to change the electrical length of the stub substantially by 90° in another latched state.

* * * * *